US008143522B2

(12) United States Patent
Laudenslager et al.

(10) Patent No.: US 8,143,522 B2
(45) Date of Patent: Mar. 27, 2012

(54) LAN CABLE AND METHOD FOR MAKING THE SAME

(75) Inventors: Michael Laudenslager, Landisville, PA (US); Frederic Jean, Manheim, PA (US); Donald Stevens, Lancaster, PA (US); Robert Kindt, Lititz, PA (US)

(73) Assignee: Nexans, Paris (FR)

( * ) Notice: Subject to any disclaimer, the term of this patent is extended or adjusted under 35 U.S.C. 154(b) by 440 days.

(21) Appl. No.: 12/405,911

(22) Filed: Mar. 17, 2009

(65) Prior Publication Data

US 2010/0236812 A1 Sep. 23, 2010

(51) Int. Cl.
*H01B 7/00* (2006.01)

(52) U.S. Cl. ..... 174/110 R; 174/113 R

(58) Field of Classification Search ..... 174/110 R, 174/113 R, 113 C, 36, 115, 116
See application file for complete search history.

(56) References Cited

U.S. PATENT DOCUMENTS

| | | | | |
|---|---|---|---|---|
| 6,462,268 | B1 * | 10/2002 | Hazy et al. | 174/36 |
| 7,262,366 | B2 * | 8/2007 | Clark | 174/113 R |
| 2007/0193769 | A1 * | 8/2007 | Clark et al. | 174/113 R |

* cited by examiner

*Primary Examiner* — William Mayo, III
(74) *Attorney, Agent, or Firm* — Sofer & Haroun, LLP

(57) ABSTRACT

A cable has at least a first layer of twisted pairs, having a combination of unshielded twisted pairs, and shielded twisted pairs as well as a second layer of twisted pairs, also having a combination of unshielded twisted pairs, and shielded twisted pairs.

17 Claims, 6 Drawing Sheets

LAN CABLE AND METHOD FOR MAKING THE SAME

BACKGROUND

1. Field of the Invention

This application relates to cable construction. More particularly, the present invention relates to an improved LAN (Local Area Network) cables construction.

2. Related Art

In the field of cable construction, particularly LAN cables, ever advancing bandwidth requirements are requiring new and innovative ways to meet the desired testing requirements. For example, the cabling standard TIA 568-B.2-10 2008 defines augmented category 6 cabling (Cat 6a). This standard defines the parameters for running 10 Gigabit signaling over Cat 6a copper cable (for 10GBASE-T). This standard specifies cabling performance to 500 MHz and includes certain performance specifications and test requirements for internal and Alien Crosstalk, among other electrical parameters.

Typically, in prior art arrangements shorter lay length pairs are used in multi-pair cables to reduce cross-talk. However, shorter lay lengths use more wire per length of cable, and thus there are limitations on how short the lay length can be in any given copper wire twisted pair. Therefore, it is ideal to have the longest lay length possible that meets the desired crosstalk threshold.

In addition to the crosstalk that occurs between pairs within the same sub-group (unit of 4 adjacent pairs), an additional type of interference occurs between twisted pairs of adjacent sub-groups (4 pairs groups) and between pairs of adjacent cables referred to as ALIEN crosstalk. Although crosstalk within a sub-group (4 adjacent pairs) is easier to manage because the lay lengths of the closest pairs can be tightly managed, ALIEN crosstalk is harder to mitigate within the cable itself due to the sub-group (unit of 4 adjacent pairs) proximity.

The ALIEN crosstalk is difficult to predict and mitigate since external cable conditions, such as the number of adjacent cables having the same twist rate from cable to cable; the distance between adjacent cables; longer pair lay length in adjacent cables; unknown lay lengths of twisted pairs in adjacent cables; etc. . . . , can not be easily predicted.

Regarding the application of Cat 6a standards, in particular, in the area of larger 24 twisted pair cables, several different options have been pursued in the prior art. For example, for UTP (Unshielded Twisted Pairs) cables, the 24-unshielded twisted pairs are bundled within the outer jacket into six 4 pair sub-cables, which together are Cat 6a, 10GBASE-T compliant. Such an arrangement is shown in prior art FIG. 1. FIG. 2 also shows a prior art arrangement with six four-pair sub cable having a central filler.

In another prior art arrangement in STP (Shielded Twisted Pairs) cables, to produce a 24 pair Cat 6a 10GBASE-T compliant cable, the twisted pairs are disposed in two concentric layers, the inner having 9 pairs and the outer layer having 15 pairs. Each of these pairs is individually shielded. An example of this design is shown in prior art FIG. 3.

However, in each prior art case, the construction arrangement used to make these cables Cat 6a 10GBASE-T compliant have added significant size (diameter), weight and costs to the cables.

For example, the cable shown in FIG. 1 utilizes a significant amount of additional polymers, such as FRPVC (Flame Retardant Polyvinyl Chloride) for each of the sub-jackets as well as with the larger outer jacket. Not only does this provide an enormous amount of fuel making it difficult to pass fire safety standards, it also adds significant size to the cable making it unsuitable for particular uses. Typically, such prior art cables are approximately 1.0" in diameter.

One such standard that these types of cables need to meet is the NEC (National Electric Code) fire safety standard for "Riser" rating, abbreviated—CMR. Cables designed as shown in FIG. 1 do not always meet the CMR standards and are poorly suited for risers anyway given their large diameters.

Likewise, the cable shown in FIG. 2, also uses FRPVC and has a typical diameter of approximately 0.8"-0.9." Such designs utilize a significant amount of shielding, and also have added fuel (because of the thicker jackets on the pair wires themselves owed to the shielding). Furthermore, 24 separate shielded pairs requires 24 separate ground terminations for the installer, which is undesirable.

In each these two cases, although the cables meet the desired transmission performance ratings, the diameters, weight, cost and other poor design qualities of these cables make them unacceptable for many applications.

In view of these concerns outlined above, prior art cables have implemented many features necessary to meet various transmission performance standards, but in doing so have negatively impacted the traditional physical standards that cables must also meet.

OBJECTS AND SUMMARY

The present invention overcomes the drawbacks associated with the prior art and provides a 24 twisted pair cable design that reduces ALIEN crosstalk between pairs of adjacent sub-groups (sub-unit of four pairs within a cable as well as ALIEN crosstalk between pairs in adjacently arranged cables. In one arrangement such a cable is cat 6a 10GBASE-T compliant, while simultaneously being lighter, smaller, easier to produce, more flexible, and less expensive than prior designs. Moreover, a LAN cable according to the present invention may be CMR (riser), CMP (Plenum) CM (general-communication) and LSZH (Low-Smoke Zero Halogen) fire rated and concurrently well dimensioned for such riser usage.

To this end, the present invention provides for a cable that reduces ALIEN crosstalk between pairs of adjacent sub-groups while reducing the amount of electrical barriers (shielding) or physical spacing required to achieve desired crosstalk performance.

In one embodiment, a cable is provided at least a first layer of twisted pairs, having a combination of unshielded twisted pairs, and shielded twisted pairs and a at least a second layer of twisted pairs, having a combination of unshielded twisted pairs, and shielded twisted pairs.

BRIEF DESCRIPTION OF THE DRAWINGS

The present invention can be best understood through the following description and accompanying drawings, wherein.

DETAILED DESCRIPTION

Figure 4:
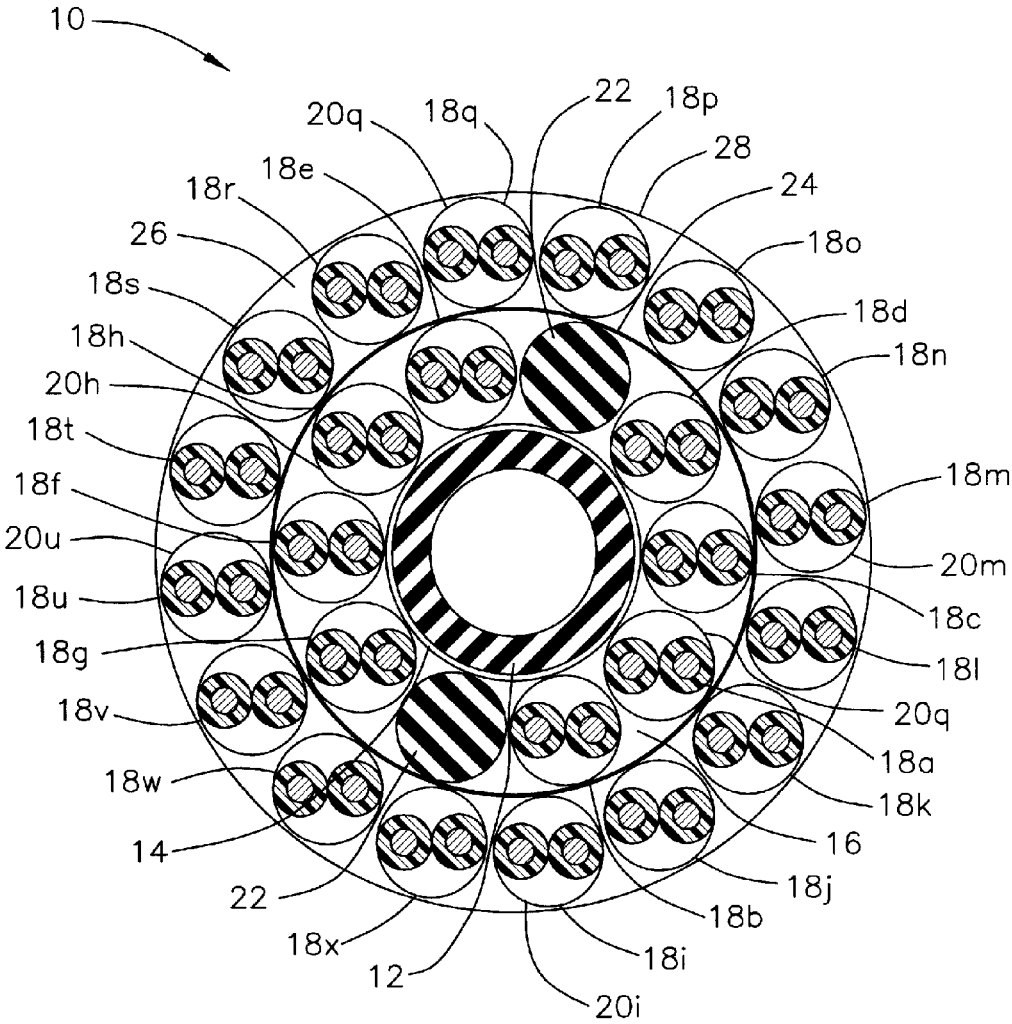
FIG. 4 is a cat 6a 10GBASE-T compliant cable according to the present invention.

In one embodiment of the present invention, as shown in FIG. 4, a cable 10 is provided. Describing the elements from the center outwards, a central filler tube 12, preferably constructed of as a tubular FRPVC element that is used to maintain proper circular cable geometry. It is noted that, in the present application FRPVC is used as an exemplary polymer. However, it is understood that this is intended only as an example and that other polymers may be used as desired, based on particular design implementations of the various embodiments.

Surrounding central filler tube 12 is an aluminum/polyester shielding tape 14, metal facing outwards. Layer 14 advantageously provides shielding between the inner layer pairs (described below) for improving cross talk performance. In one exemplary arrangement, tape 14 is a composite tape of 1 mil thickness polyester film with 1.5 mils of aluminum foil, applied longitudinally during the cabling process.

Figure 2:
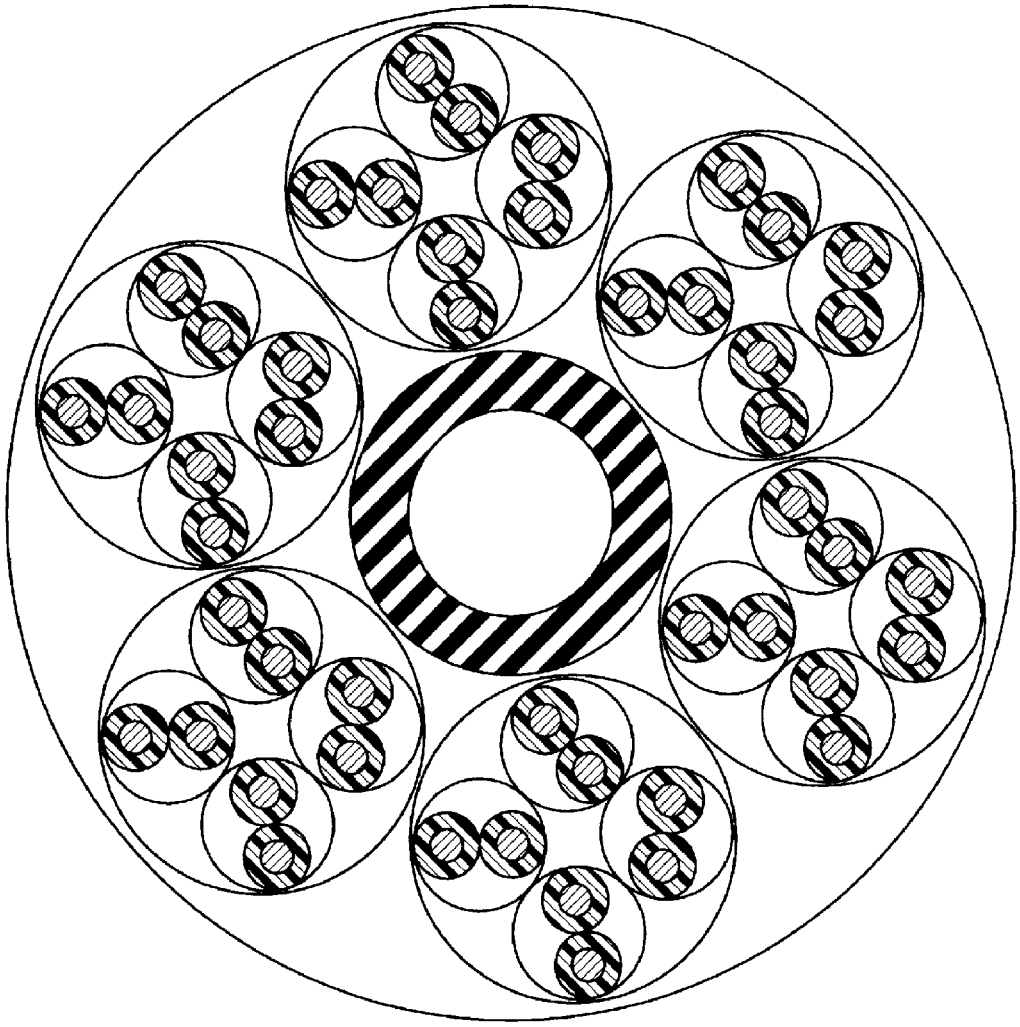
FIG. 2 (PRIOR ART)
FIG. 2 is a different prior art cat 6a 10GBASE-T compliant cable.

Around the aluminum/polyester shielded central tube 12, eight of the twenty four twisted pairs of cable 10 are arranged in a first twisted pair layer 16. These eight twisted pairs are labeled as elements 18*a*-18*h*. Instead of shielding each of pairs 18*a*-18*h*, as for example in prior art FIG. 2, only two pairs, such as pair 18*a* and 18*h* are shielded. Preferably twisted pairs 18*a* and 18*h* are shielded using aluminum/polyester shielding layers 20*a* and 20*h* respectively. Also included in first pair layer 16 are two monofilaments 22, preferably made of FRPVC, although the invention is not limited in that respect. These monofilaments 22 are added to maintain the proper cable geometry and roundness in cable 10.

As shown in FIG. 4, preferably, each of monofilaments 22 are disposed opposite one another, dividing first twisted pair layer 16 into two sets of four pairs (18*a*-18*d* and 18*e*-18*h*), each of which has one of the two shielded pairs of layer 16. This arrangement helps balance the structure of layer 16 as well as to spread the cross-talk resisting benefits of the shielded pairs 18*a* and 18*f* around the circumference of cable 10.

Figure 3:
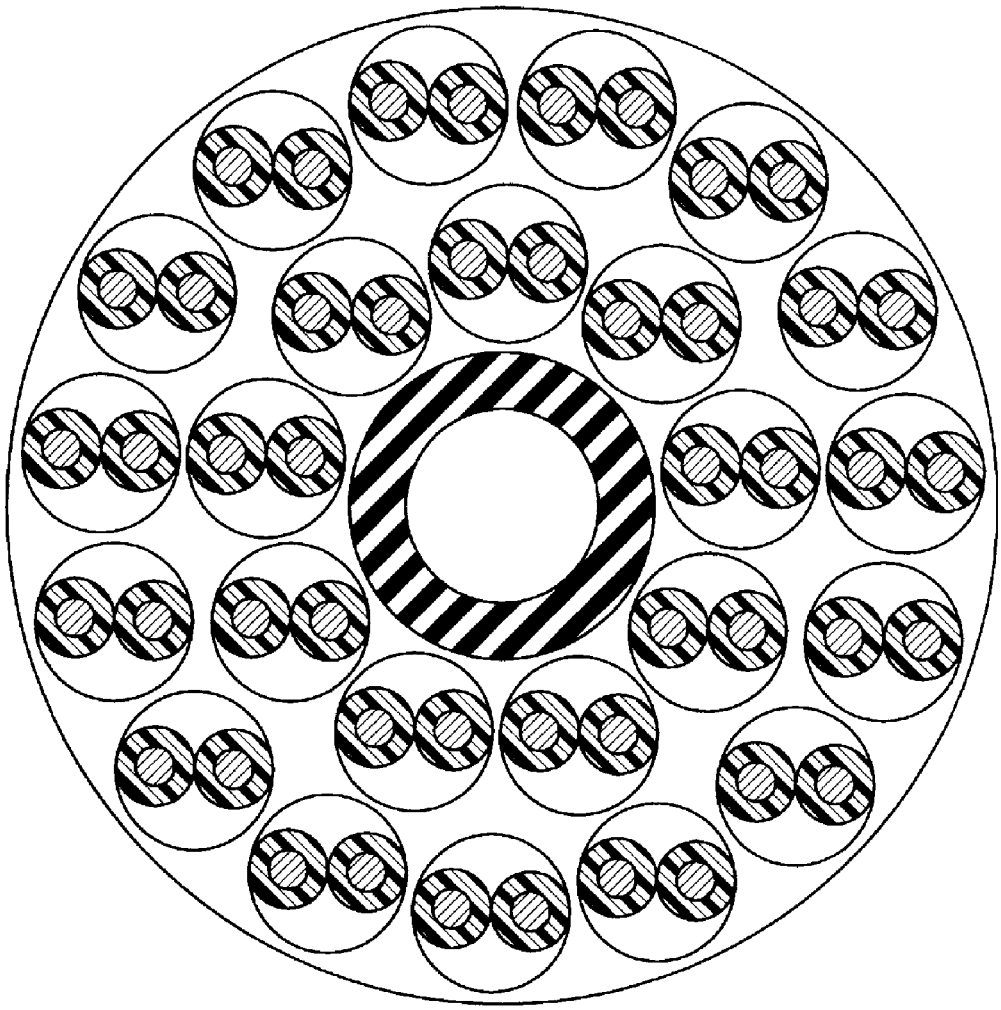
FIG. 3 (PRIOR ART)
FIG. 3 is a different prior art cat6a 10GBASE-T complaint cable.

Around first pair layer 16 is an aluminum/polyester/aluminum wrapping 24. Over this wrapping is the second pair layer 26 including the remaining sixteen twisted pairs 18 of the twenty-four pair cable 10. As shown in FIG. 3, these sixteen pairs are labeled 18*i*-18*x*. Preferably pairs 18*i*, 18*m*, 18*q* and 18*u* are shielded using aluminum/polyester shielding layers 20*i*, 20*m*, 20*q* and 20*u* respectively. The spacing of one shielded pair 18 for each successive four pairs 18 within layer 26 (successive being defined circumferentially) helps spread the cross-talk resisting benefits of the shielded pairs 18*i*, 18*m*, 18*q* and 18*u* around the circumference of cable 10.

To obtain the required crosstalk performance between the 4-pair groups in cable 10, shielding of only a portion of the pairs was chosen. Although spacing can be used (as in prior art FIG. 1) by using increased jacket thicknesses, this results in an overall larger cable design as discussed above. Moreover, as shown in prior art FIG. 2 each of the pairs are shielded to meet Cat 6a standards. However, to meet the 100 Ohm required impedance, these shielded pairs generally need to be larger than unshielded pairs, resulting in a larger outside cable diameter.

The present arrangement uses a reduced number of shielded pairs, (six of the twenty four), placing them in strategic locations within the two layers 16 and 26 of cable 10 to have the greatest impact to the crosstalk performance. The other shielding 14 and 24 within cable 10 contacts the shields (20) on each of the pairs (18) creating envelopes of individually unshielded pairs resulting in an overall cable 10 which is smaller, weighs and cost less, and is easier to process and terminate.

Finally, over the outside of second twisted pair layer 26 a polymer jacket 28, preferably FRPVC, is applied, possibly by extrusion, to form the outer barrier for cable 10.

Thus cable 10, according to the above described design, provides a twenty four pair cat 6a 10GBASE-T compliant LAN cable. This cable advantageously has a diameter that does not exceed 0.60", preferably 0.550", and is also CMR compliant. However, unlike the prior art, the design minimizes the use of shielding material (as opposed to prior art FIG. 2) and does not require complicated and expensive internal sub-cabling (as opposed to prior art FIG. 1). For example, the present arrangement represents a potential reduction in the outside cable diameter of approximately 45% with respect to prior art FIG. 1 and a potential 67% reduction in shield lengths over the prior art FIG. 3.

Figure 5:
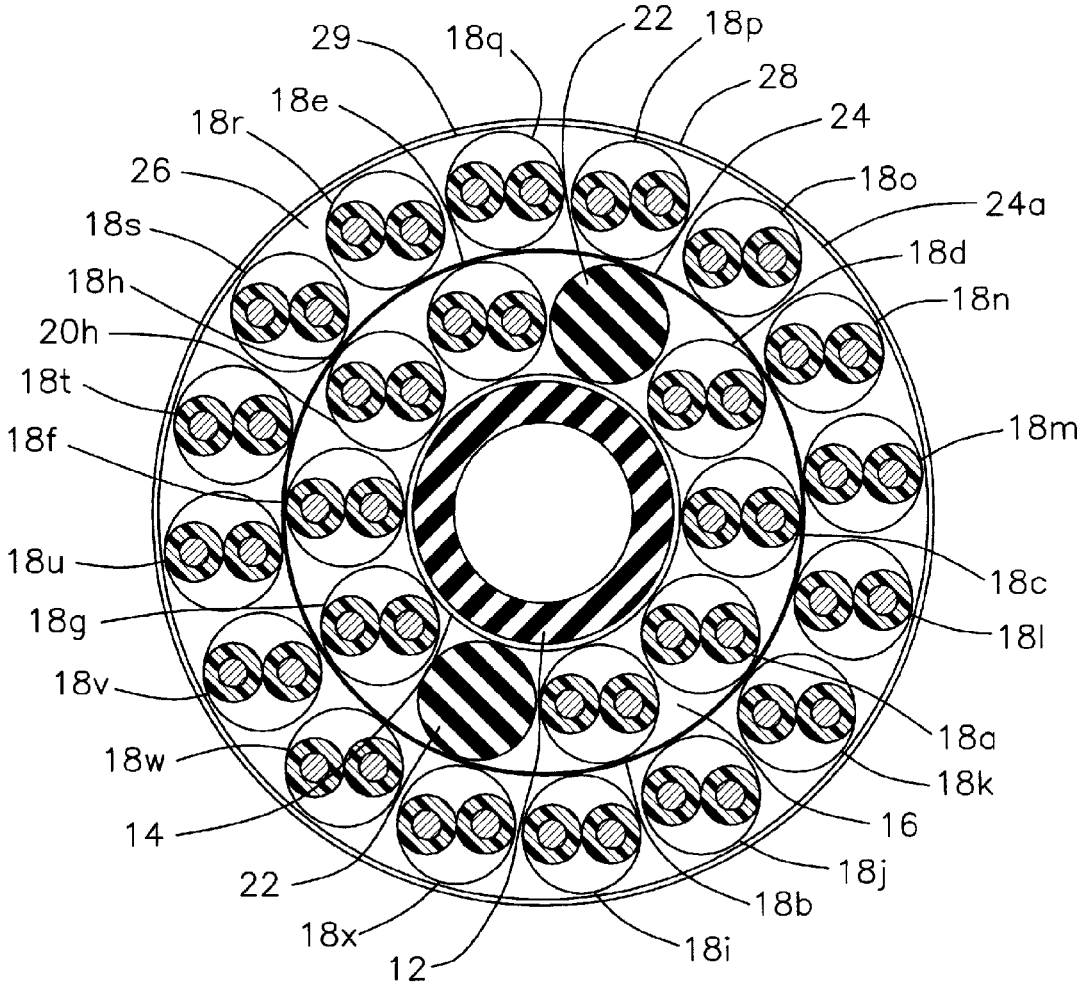
FIG. 5 is a cat 6a 10GBASE-T compliant cable according to another embodiment.

In another arrangement, as shown in FIG. 5, an alternative arrangement is shown which is substantially similar to the arrangement described above with relation to FIG. 4. However, in this arrangement, a third shielding layer 24(A), preferably made from aluminum/polyester tape, is added around the outside of second twisted pair layer 26, under jacket 28. Such a configuration may add additional protection to reduce ALIEN crosstalk with respect to pairs located in adjacently lying cables.

Figure 6:
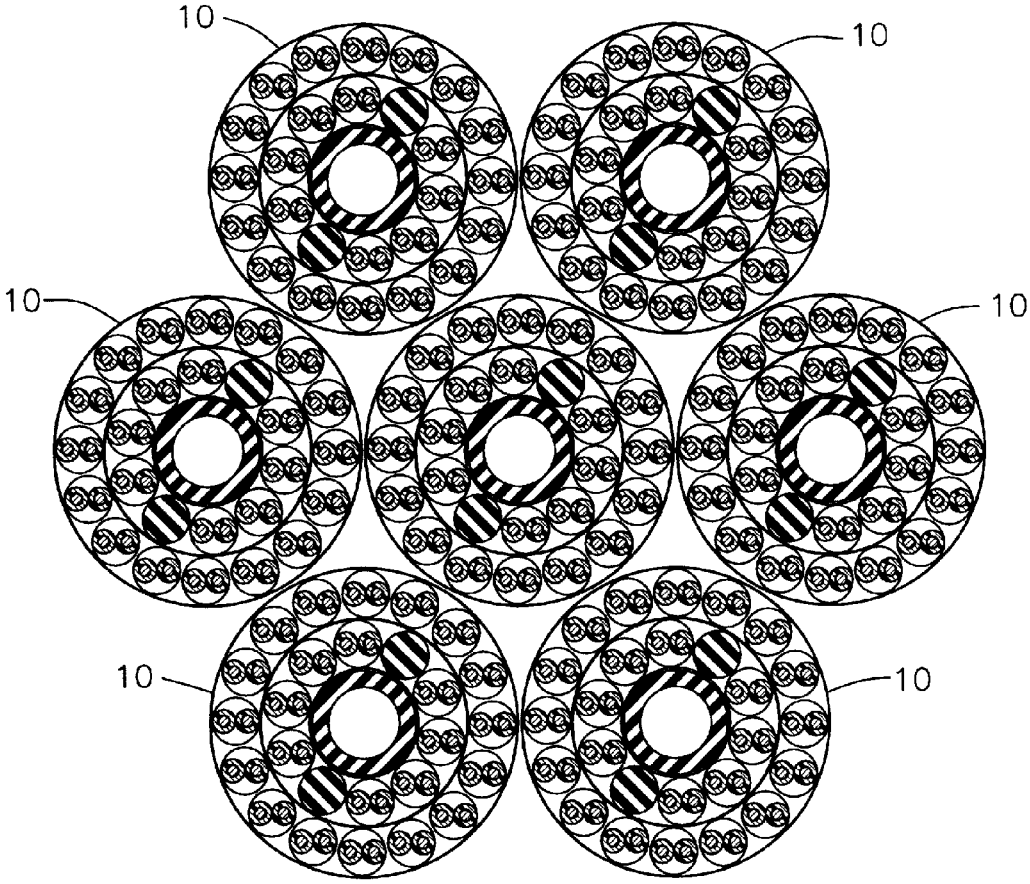
FIG. 6 illustrates seven adjacently lying cables from FIG. 4, in accordance with one embodiment.

As an exemplary arrangement, FIG. 6 shows a typical installation of seven adjacently lying cables 10. For meeting ALIEN Crosstalk requirements, not only must the individual groups of 4-pairs within cables 10 meet the relevant ALIEN crosstalk requirements, but the pairs must also be able to meet the ALIEN crosstalk requirements with respect to pairs located in the adjacent cables 10. The embodiments set forth above meet the necessary requirements with significantly less bulk and with greater flexibility than prior art cables, such as those shown in FIGS. 1-3.

Figure 1:
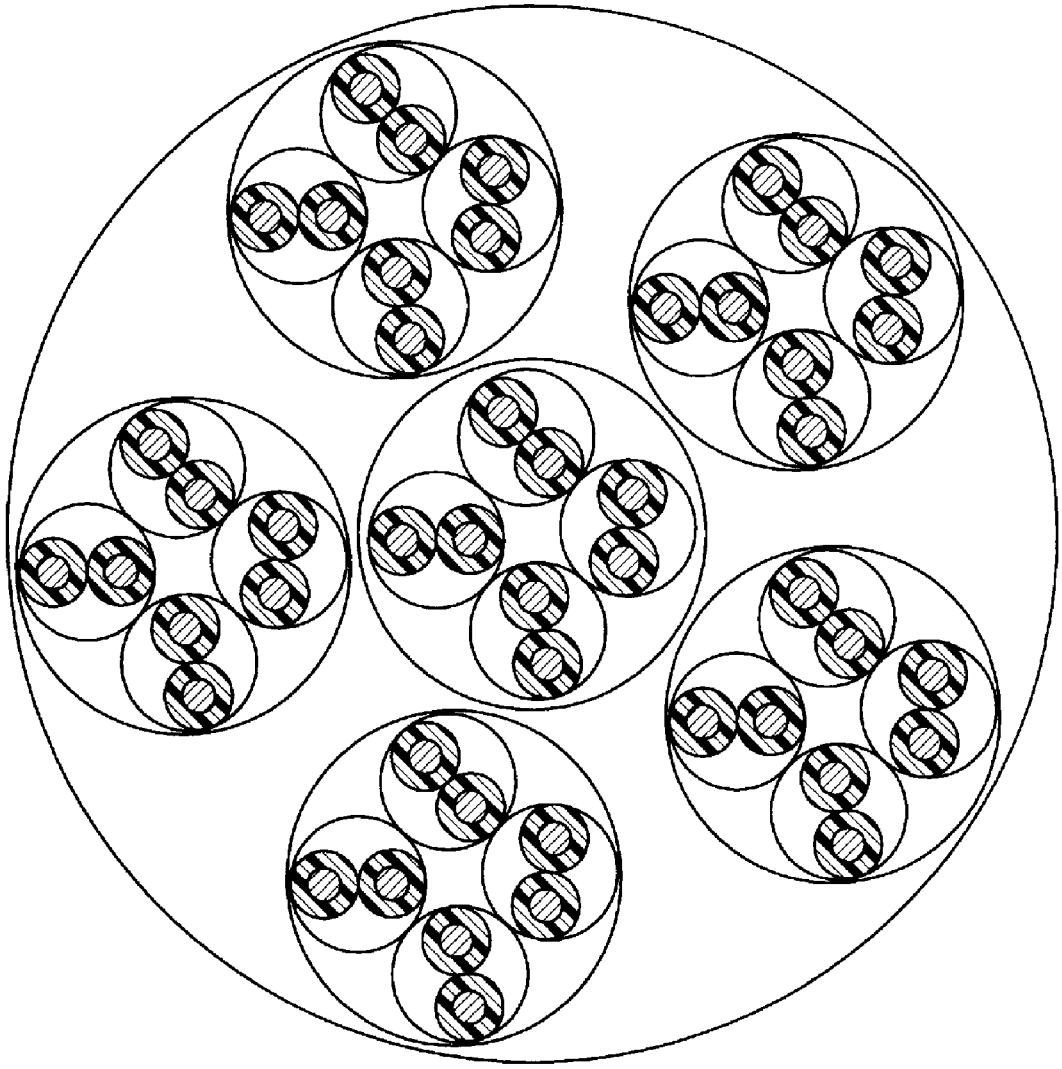
FIG. 1 (PRIOR ART)
FIG. 1 is a prior art cat 6a 10GBASE-T compliant cable.

It is noted that typical prior art constructions such as those shown in FIG. 1, typical 4-pair cable coloring is used within each of the six sub-cables. To visually identify the difference between the 4-pair bundled sub-cables, different jacket colors for these sub-cables is typically used. However, when the outer cable jacket is cut back for termination, the installer still ends up with several individual pairs, from the 24 pair bundle of the same color. In one embodiment of the present invention, it is contemplated that the above described design eliminates the need for multiple jacket colors by following the industry standard color code for multi-pair cables colored directly onto the 24 pairs.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A cable, said cable comprising:

at least a first layer of twisted pairs, having a combination of unshielded twisted pairs, and shielded twisted pairs; and at least a second layer of twisted pairs, having a combination of unshielded twisted pairs, and shielded twisted pairs.

2. The cable as claimed in claim 1, wherein said cable is a 24 twisted pair cable.

3. The cable as claimed in claim 2, wherein said first layer of twisted pairs, has eight twisted pairs, of which two pairs are shielded.

4. The cable as claimed in claim 3, further comprising two monofilaments, arranged in said first layer of twisted pairs, such that there are four twisted pairs on either said of said monofilaments.

5. The cable as claimed in claim 4, wherein each group of four twisted pairs on either side of said monofilaments includes one said two shielded twisted pairs in said first layer of twisted pairs.

6. The cable as claimed in claim 2, wherein said second layer of twisted pairs, has sixteen twisted pairs, of which four pairs are shielded.

7. The cable as claimed in claim 6, wherein each said four shielded twisted pairs in said second layer of twisted pairs are separated by three unshielded twisted pairs on either side.

8. The cable as claimed in claim 6, wherein said has a jacket made from FRPVC.

9. The cable as claimed in claim 6, wherein said cable has an outside diameter of less than 0.6."

10. The cable as claimed in claim 1, further comprising a central filler tube.

11. The cable as claimed in claim 10, further comprising a metal shielding tape around said central filler tube.

12. The cable as claimed in claim 11, wherein said metal shielding tape is an aluminum/polyester tape.

13. The cable as claimed in claim 1, further comprising a wrapping layer disposed between said first layer of twisted pairs and said second layer of twisted pairs.

14. The cable as claimed in claim 13, wherein said wrapping layer is a shielding tape made of an aluminum/polyester/aluminum tape.

15. The cable as claimed in claim 1, further comprising a wrapping layer disposed between said second layer of twisted pairs and an outer jacket of said cable.

16. The cable as claimed in claim 15, wherein said wrapping layer is a shielding tape made of an aluminum/polyester tape.

17. The cable as claimed in claim 1, wherein said combination of said unshielded twisted pairs, and shielded twisted pairs in said first and second layers is sufficient for said cable to meet Cat6A standards.

* * * * *